US008844445B2

(12) United States Patent
Brenny et al.

(10) Patent No.: US 8,844,445 B2
(45) Date of Patent: Sep. 30, 2014

(54) ANCHOR CRIBBER

(71) Applicant: Racine Railroad Products, Inc., Racine, WI (US)

(72) Inventors: David M. Brenny, Eagle, WI (US); Jeff Hon, Rochester, WI (US); Frank Gall, III, Racine, WI (US)

(73) Assignee: Racine Railroad Products, Inc., Mt. Pleasant, WI (US)

( * ) Notice: Subject to any disclaimer, the term of this patent is extended or adjusted under 35 U.S.C. 154(b) by 0 days.

(21) Appl. No.: 13/679,001

(22) Filed: Nov. 16, 2012

(65) Prior Publication Data

US 2013/0125775 A1 May 23, 2013

Related U.S. Application Data

(60) Provisional application No. 61/561,360, filed on Nov. 18, 2011.

(51) Int. Cl.

| | |
|---|---|
| ***E01B 29/05*** | (2006.01) |
| ***E01B 27/04*** | (2006.01) |
| ***E01B 27/00*** | (2006.01) |

(52) U.S. Cl.

CPC ..... *E01B 27/00* (2013.01); *E01B 27/04* (2013.01)

USPC ..... 104/2; 37/104

(58) Field of Classification Search

CPC ..... E01B 27/04; E01B 27/00; E01B 27/10

USPC ..... 104/2–6; 37/104

See application file for complete search history.

(56) References Cited

U.S. PATENT DOCUMENTS

| | | | | | |
|---|---|---|---|---|---|
| 2,463,499 | A | * | 3/1949 | Thornley | 37/104 |
| 2,574,118 | A | * | 11/1951 | McWilliams | 37/104 |
| 2,664,652 | A | * | 1/1954 | Talboys | 37/195 |
| 2,669,041 | A | * | 2/1954 | Fox et al. | 37/104 |
| 2,743,539 | A | * | 5/1956 | Hursh et al. | 37/104 |
| 3,005,274 | A | * | 10/1961 | Kershaw | 37/104 |
| 3,543,297 | A | * | 11/1970 | Blackwell, Jr. | 37/104 |
| 3,553,859 | A | * | 1/1971 | Mcilrath | 37/104 |
| 3,826,195 | A | * | 7/1974 | Bucksch | 104/2 |
| 4,102,066 | A | * | 7/1978 | Christoff | 37/104 |
| 4,561,198 | A | * | 12/1985 | Holley | 37/104 |
| 4,850,123 | A | * | 7/1989 | Whitaker, Jr. | 37/104 |
| 2013/0125775 | A1 | * | 5/2013 | Brenny et al. | 104/2 |

* cited by examiner

*Primary Examiner* — Jason C Smith

(74) *Attorney, Agent, or Firm* — Boyle Fredrickson, S.C.

(57) ABSTRACT

An anchor cribbing machine includes a pair of ballast cribbing assemblies and a pair of rail clamp assemblies. The ballast cribbing assemblies are hydraulically-driven to push ballast away from the opposing sides of a railroad tie so that an anchor may be applied to the rail at the tie location. The ballast cribbing assemblies include support beams that are movable longitudinally relative to the rails and rotatable between an operative and a stowed position. The rail clamp assemblies are configured to engage the rail to prevent the machine from being driven off the rails in operation.

22 Claims, 11 Drawing Sheets

ANCHOR CRIBBER

CROSS-REFERENCE TO RELATED APPLICATION

This application claims priority to U.S. provisional application Ser. No. 61/561,360, filed Nov. 18, 2011, the entire contents of which are incorporated herein by reference.

BACKGROUND OF THE INVENTION

1. Field of the Invention

The invention generally relates to railroad ballast cribbers. More particularly, the invention relates to a ballast cribber that is configured to remove the potentially-interfering ballast adjacent a railroad tie. In a particularly conferred configuration, the invention relates to an anchor cribber that can be used with an anchor applicator so as to remove ballast adjacent the tie and then apply one or more rail anchors at the railroad tie location without repositioning the anchor cribber or requiring an additional tool or machine.

2. Discussion of the Related Art

Anchor cribbing machines for preparing a railway for applying one or more anchors at a railroad tie location are well known in the art. Such known anchor cribbing machines typically require the removal of a rail and the operation of a specialized machine, often called a ballast cribber, to remove the underlying and interfering ballast from around the railroad tie so as to enable an anchor applicator to apply one or more anchors at a given tie location.

As removing the rail is a relatively time-consuming and labor-intensive process, some anchor applicators are capable of applying the anchor to the rail without requiring removal of the rail. That is, the anchor may be applied to the rail while the rail is in place. However, such known anchor applicators still require a specialized machine, i.e. a ballast cribber, for removing the ballast from adjacent the railroad tie so that the anchor may then be applied by the anchor applicator.

The need therefore exists to provide a ballast cribber, usable with or without an anchor applicator, that eliminates one or more of these disadvantages.

SUMMARY OF THE INVENTION

In accordance with a first aspect of the invention, the above-identified and other needs are met by providing a ballast cribbing machine or "cribber" configured to drive ballast away from under the rail so that, for example, an anchor applicator can apply an anchor to the rail next to the tie. The cribber may further include a rail clamp assembly configured to prevent the machine from being driven off rails in the event that the cribber engages the rail or the ballast during operation with sufficient force to drive the machine away from the rail.

In one embodiment, the cribber includes at least one, and preferably two, ballast cribbing assemblies movably coupled to a frame of the machine. The ballast cribbing assembly includes a cribber tool or ram coupled to a piston that is selectively extendible and retractable from a cylinder. A link is pivotally coupled to the frame of the machine at one end and to the cribber tool at another end. Thus, as the piston extends and retracts relative to the cylinder, the cribber tool swings about the link under the railroad rail to force the surrounding ballast away from the adjacent railroad tie.

The cribber may be configured to position the cribber tool as closely as possible to the edge of the associated tie. In particular, the ballast cribber assembly includes a support beam to which the cribber tool is coupled and which is supported by one or more guide rods. The beam is coupled to a hydraulic cylinder for driving the beam along the guide rods in a longitudinal direction along the rails or toward or away from the ties.

To ensure that the cribber is not encumbered by any obstacles while moving along the rails, the ballast cribbing assembly may be moved between a deployed or operative position and a stowed or stored position. In the deployed position of the ballast cribbing assembly, the cribbing tool hangs beneath the support beam and is positioned for selective engagement with the ballast surrounding the tie. When the ballast cribbing assembly is in the stowed position, the cribbing tool is positioned above a height of the railroad rails. In this manner, the ballast cribbing assemblies are able to move longitudinally relative to the rails so as to closely position the ballast cribbing assemblies relative to the ties without being interfered with by the railroad rails or concrete crossings, thus avoiding any potential damage to the ballast cribbing assemblies.

Each rail clamp assembly includes a clamp selectively engageable with the railroad rail to secure the machine to the rail. The clamp is coupled to a piston that is extendible and retractable relative to a cylinder for driving the rail clamp assembly into and out of engagement with the rail.

The anchor cribbing machine is operated via a controller assembly, which may include one or more toggle switch (es), joystick(s) or the like. The controller assembly may include a button, trigger or the like for actuating an anchor applicator assembly for selectively applying the anchor to the rail after the cribbing process is completed adjacent those that require cribbing. The controller assembly may be configured to control movement of the cribber tool toward or away from the railroad rails and to control the rotation of the ballast cribbing assembly between the stowed and operative positions. In at least one construction, the controller assembly includes a four-way toggle controller that controls the ballast cribber assembly and a trigger configured to apply the anchor to the railroad rail.

Various other features, embodiments and alternatives of the present invention will be made apparent from the following detailed description taken together with the drawings. It should be understood, however, that the detailed description and specific examples, while indicating preferred embodiments of the invention, are given by way of illustration and not limitation. Many changes and modifications could be made within the scope of the present invention without departing from the spirit thereof, and the invention includes all such modifications.

BRIEF DESCRIPTION OF THE DRAWINGS

Preferred exemplary embodiments of the invention are illustrated in the accompanying drawings, in which like reference numerals represent like parts throughout, and in which.

DETAILED DESCRIPTION OF THE PREFERRED EMBODIMENTS

Figure 1:
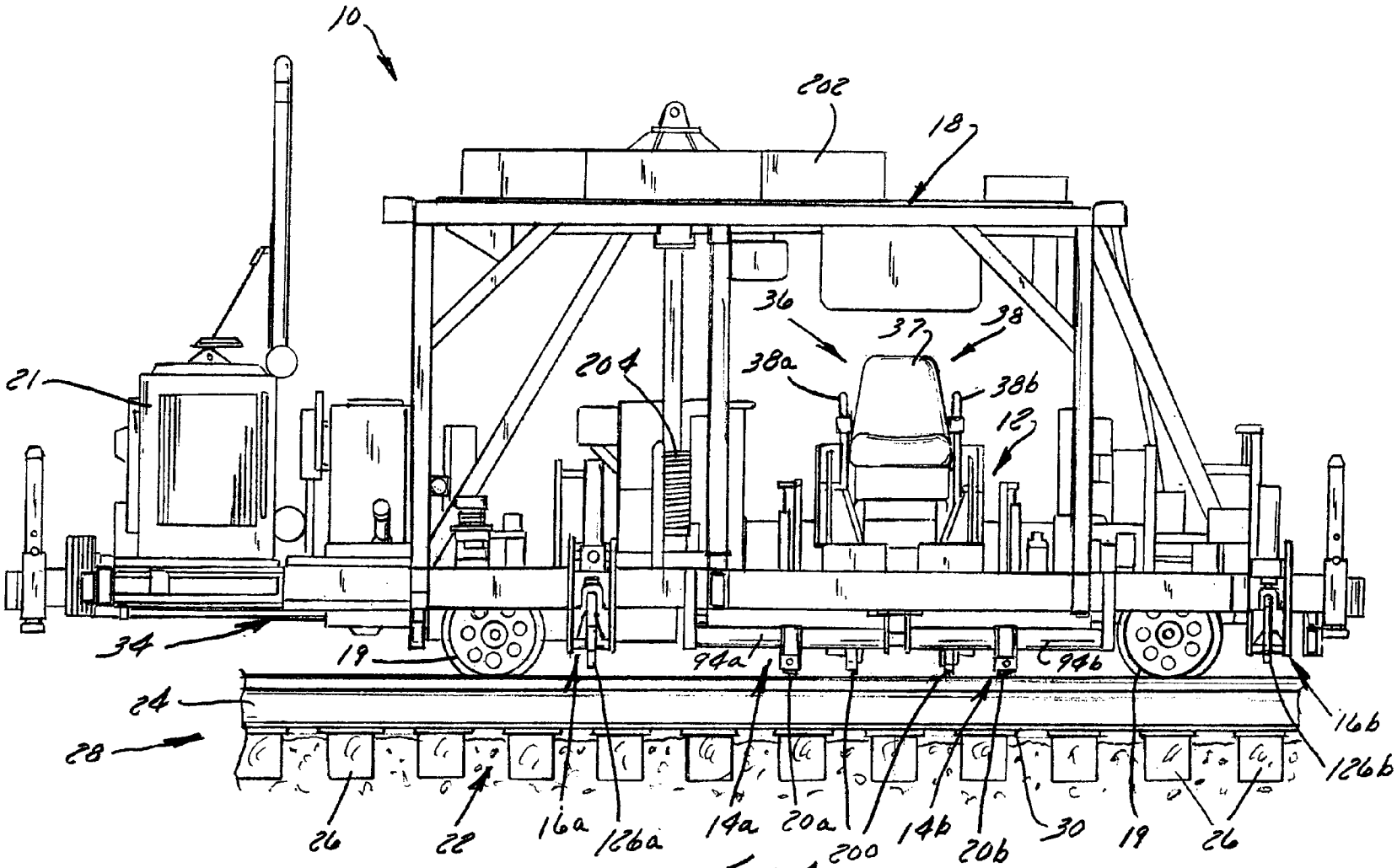
FIG. 1 is a side elevation view of an anchor cribbing machine according to an embodiment the present invention.

Now referring to the drawings and initially to FIG. 1, a self-propelled vehicle 10, described in more detail below, bears an anchor cribbing machine 12 according to the invention. The anchor cribbing machine 12 includes a pair of ballast cribbing assemblies 14 and a corresponding pair of rail clamp assemblies 16 supported on a fixed frame 18. The vehicle 10 of this embodiment is supported directly on the opposed rails 24 of the railway via wheels 19. However, it is conceivable that the vehicle 10 could be configured to move along a railway in which the rail opposite the rail 24 being worked has been removed, in which case the opposed side of the vehicle 10 could be supported on wheels or crawlers that are supported upon the rail bed. The vehicle 10 is powered by an engine 21 mounted on the rear of the frame 18. Two anchor applicators 200 which are, per se, well known, are mounted on the frame between the ballast cribbing assemblies. The anchor applicators 200 are manually supplied with anchors (not shown) from a hopper 202 via a conveyor system 204.

Figure 2:
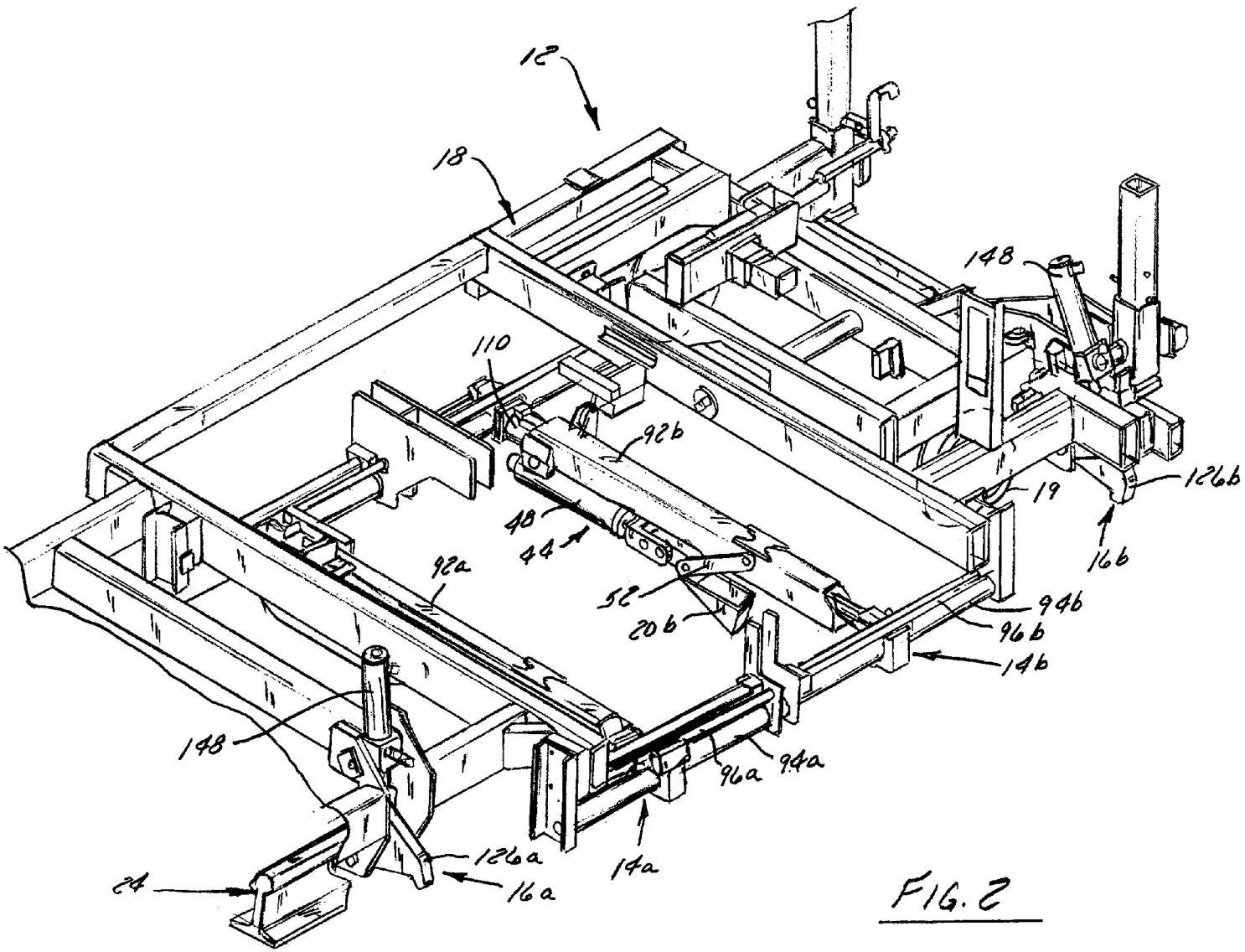
FIG. 2 is an isometric view of a portion of the anchor cribbing machine of FIG. 1.

Referring now to FIGS. 1 and 2, each of the ballast cribbing assemblies 14 of the anchor cribber machine 12 includes a cribber tool or ram 20 that is configured for ramming or pushing the ballast 22 beneath a rail 24, and more particularly, away from a respective side of a railroad tie 26 supporting a rail 24 of a railroad track 28, so that the anchor applicators 200 may apply one or more anchors to the railroad rail 24 as will be discussed in additional detail herein. Two ballast cribbing assemblies 14*a*, 14*b* are provided for cribbing ballast on opposed sides of a tie 26. The ballast cribbing assemblies 14 extend at least part-way across a width of the railroad 28 over one of the rails 24. The ballast cribbing assemblies 14 are spaced relative to one another along a longitudinal length of the rails 24 so as to be disposed opposite adjacent sides of a railroad tie 26. Hence, each of the ballast cribbing assemblies 14*a*, 14*b* can remove ballast from an associated side of the tie 26.

As is generally understood, the ballast 22 generally comprises the bed upon which the railroad ties 26 are laid. The ballast 22 is packed beneath, between, and around the railroad ties 26 and used to facilitate the drainage of water, to distribute the load from the railroad ties 26, to hold the railroad track 28 in place as trains roll by, and to keep vegetation from interfering with the railroad track 28. The ballast 22 is typically made from crushed stone or the like. The railroad ties 26 are generally rectangular and serve as a base for supporting the rails 24. A railroad tie plate 30 may be interposed between the rail 24 and the ties 26. The railroad ties 26 are generally laid transversely relative to a longitudinal direction of the rails 24, and the rails 24 are fixed to the ties 26 so as to transfer the loads from the rails to the ballast 22 as well as to hold the rails 24 upright and at the correct gauge. Anchors are positioned on opposed sides of at least some of the ties and applied to the rail to help prevent creep of the rails 24 relative to the ties 26.

As discussed above, the vehicle 10 may further include one or more anchor applicator assemblies 200 configured to attach anchors to the rails 24. A suitable anchor applicator is commercially available from Racine Railroad Products of Racine, Wis., USA under the brand name "Anchormatic II". The Anchormatic II anchor applicator includes two anchor applicator assemblies 200 operable to apply anchors on a common rail on opposed sides of a tie while the vehicle 10 is positioned over the tie 26. The frame 18 of the anchor cribbing machine 12 is mounted on the main frame or chassis 34 of the vehicle 10 and positioned relative to the anchor applicators 200 so as to permit the anchor cribbing machine 12 to operate in conjunction with the anchor applicator assemblies 200 while the vehicle 10 is positioned over a tie 26.

As discussed above, two ballast cribber assemblies 14*a*, 14*b* are provided in the preferred embodiment. The assemblies 14*a* and 14*b* are mirror images of one another and are configured to remove ballast 22 from the opposite sides of a tie 26 when the machine 12 is generally centered over the tie 26. Unless otherwise specified, any description of one of the assemblies 14*a* and 14*b* should be considered to apply equally to the other assembly 14*b* and 14*a*. In addition, unless otherwise specified, any description of "a ballast cribbing assembly 14 or one or more of its components should be construed to apply equally to both ballast cribbing assemblies 14*a*, 14*b* and the associated component(s).

Figure 3:
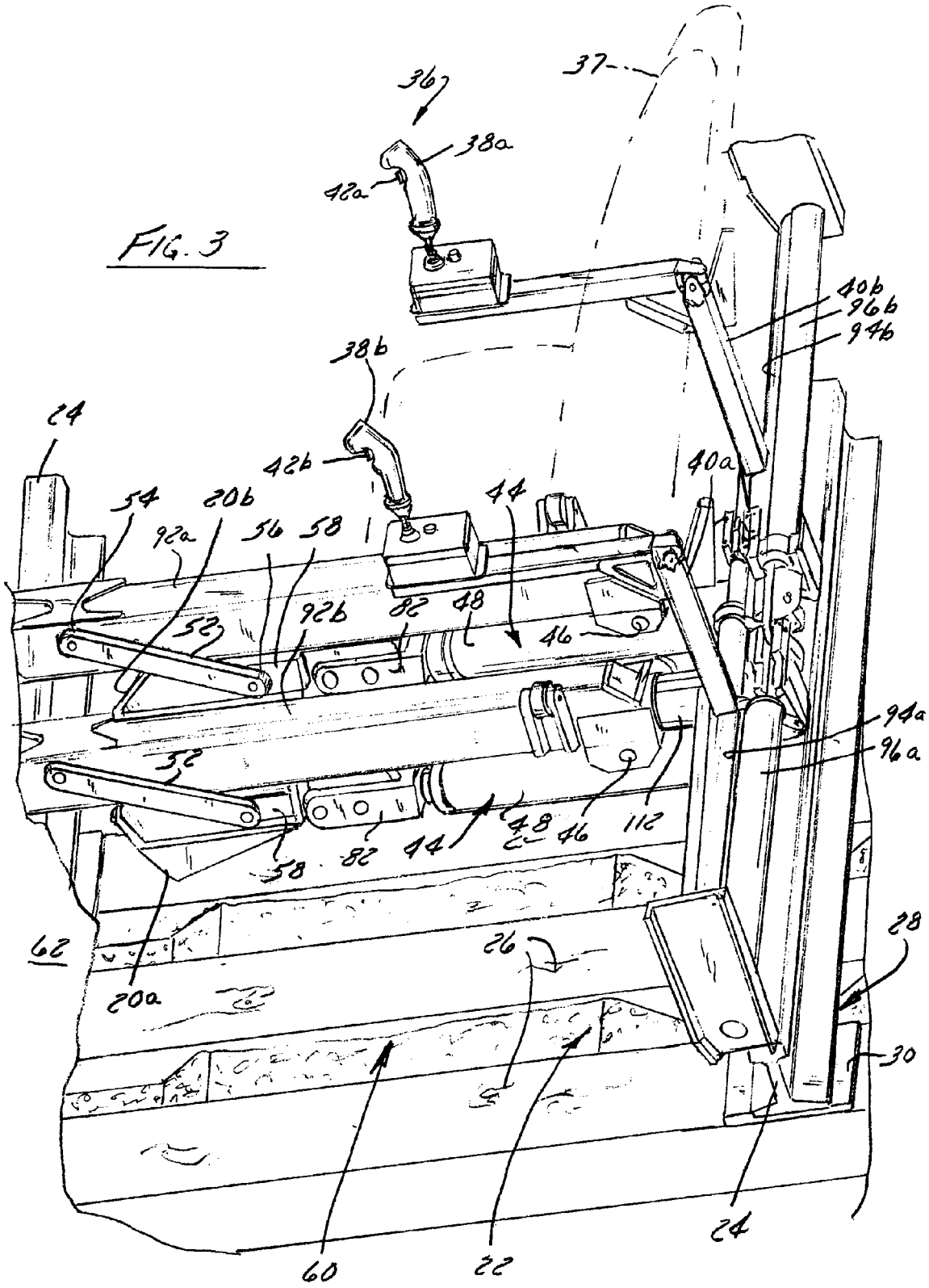
FIG. 3 is a partially cut-away isometric view of a portion of the anchor cribbing machine of FIG. 1, showing an operator's control assembly.

Still referring to FIGS. 1 and 2 and now with additional reference to FIG. 3, the anchor cribbing machine 12 additionally includes a controller assembly 36 for operating the ballast cribber assemblies 14 and the anchor applicators 200. More particularly, the controller assembly 36 may include a pair of controllers 38, shown as joysticks 38*a*, 38*b* (see FIG. 3) for respectively operating both ballast cribbing assemblies 14*a*, 14*b*, as will be discussed in additional detail herein. Each of the joysticks 38*a*, 38*b* is mounted on a respective mast 40*a*, 40*b* positioned generally over the respective anchor cribber assembly 14*a*, 14*b*. Each of the joysticks 38*a*, 38*b* may have an associated button or trigger 42*a*, 42*b* for activating the associated anchor applicator 200, as will be discussed. Each of the joysticks 38*a*, 38*b* is associated with an associated one of the ballast cribber assemblies 14*a*, 14*b* and the corresponding rail clamp assembly 16*a*, 16*b* such that actuation of one of the joysticks 38 causes a corresponding one of the ballast cribber assemblies 14 to extend and retract and one of the rail clamp assemblies 16 to extend and retract.

The joysticks 38 may be in the form of a toggle controller. Understandably, the controller assembly 36 may include a pair of toggle controllers corresponding to each of the cribber tools 20*a*, 20*b*. Similar to the joysticks 38*a*, 38*b*, the toggle controller may include a trigger for operation of the anchor applicators. The toggle controller may comprise four-way toggle switches for movement along a pair of orthogonally arranged axes, e.g. X and Y directions With continued reference to FIGS. 1 and 2, and now additional reference to FIGS. 3-5, the right ballast cribbing assembly 14*a* includes the cribber tool 20 and a linear actuator 44 that is pivotally mounted on the frame 18 so as to pivot about a pivot point 46. The linear actuator 44 of this embodiment includes a hydraulic cylinder 48 and a piston 50 that is selectively movable relative to the cylinder 48 from an initial, retracted position like that shown in FIG. 4 to an extended position shown in FIG. 5. A pair of opposed links 52 are provided at opposite sides of the ballast cribber assembly 14*a* in the area where the cribber tool 20*a* is attached to the piston 50. The links 52 are received on opposite sides of a support beam 92 and include an upper end 54 and a lower end 56. The upper end 54 is pivotally connected to the support beam 92. The lower end 56 is pivotally connected to the cribber tool 20. As the piston 50 extends and retracts from the cylinder 48, the entire ballast cribbing assembly 14*a* swings about the link 52 so that the cribber tool 20 proceeds from the retracted position (FIG. 4) to the extended position (FIG. 5). Once moved to the extended position, the cribber tool 20 swings beneath the rail 24 from the gauge side 60 of the rail 24 so as to force the ballast 22 outwardly away from the field side 62 of the rail 24 as seen in FIG. 5.

Figure 6:
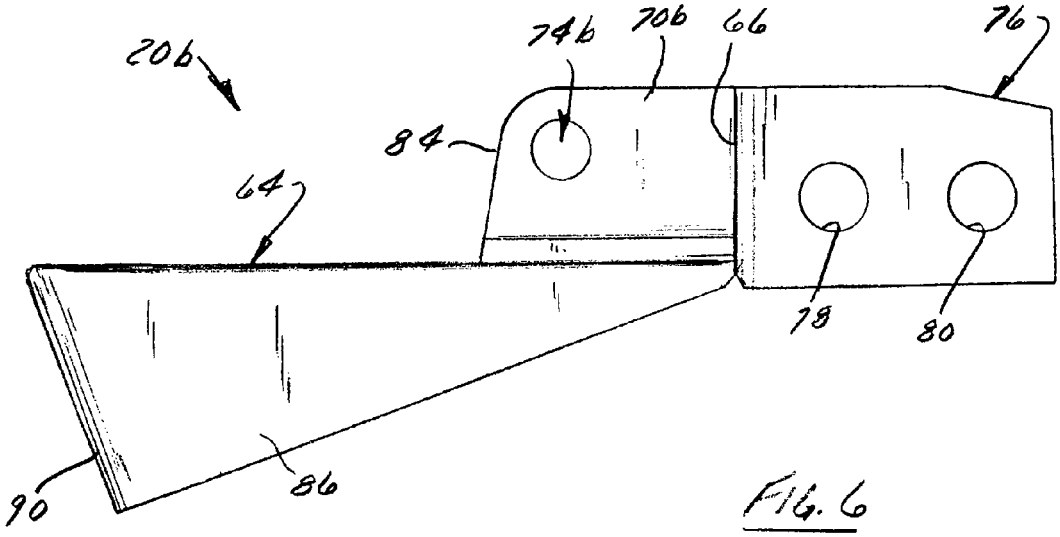
FIG. 6 is a side elevation view of a ballast cribber tool.
Figure 7:
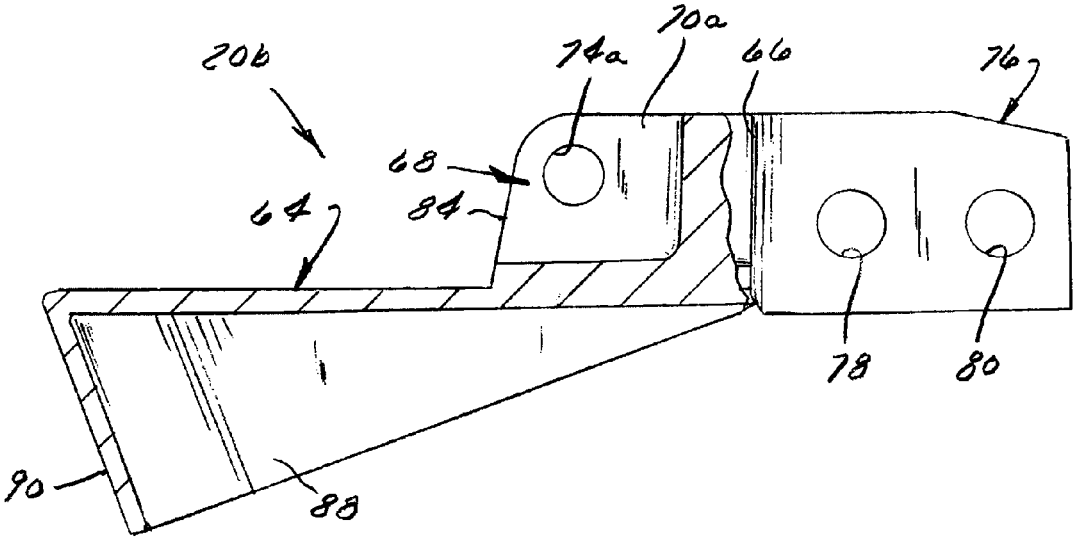
FIG. 7 is a partial cross sectional side elevation of a ballast cribber tool.
Figure 8:
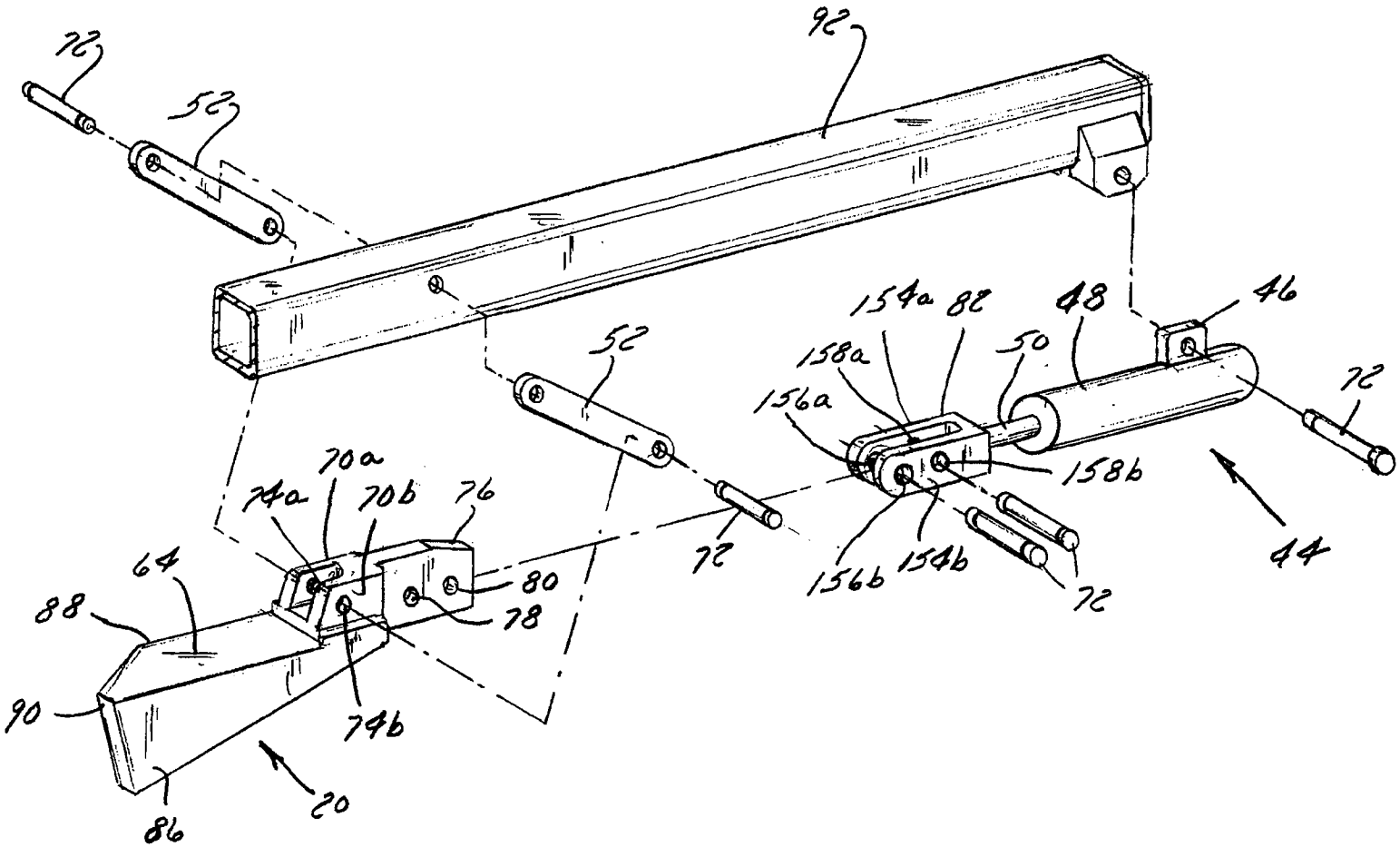
FIG. 8 is an exploded isometric view of a ballast cribbing assembly of the anchor cribbing machine of FIG. 1.

Now referring to FIGS. 6 and 7, the right cribber tool 20*b* is shown in additional detail. Tool 20*b* includes a driving portion 64 positioned forwardly relative to a connection portion 66. The cribber tool 20*b* acts like a ram that swings beneath the rail 24 and pushes the surrounding ballast 22 away from the rail 24 so that the vehicle 10 may apply an anchor to the rail 24 adjacent the right edge of the tie 26. The driving portion 64 is located outboard relative to a pinpoint 68 for coupling the cribber tool 20 to the link 52. The pinpoint 68 is defined by a pair of ears 70*a*, 70*b* (see FIG. 8) between which the link 52 is to be received and coupled to the cribber tool 20 via a pin 72 or the like. The ears 70*a*, 70*b* include corresponding apertures 74*a*, 74*b* through which the pin 72 or other fastener may be received. Inboard of the ears 70*a*, 70*b* relative to the driving portion 64 is a coupling portion 76, which includes a pair of apertures 78, 80 configured to receive pins 72 for securing the cribber tool 20 to the piston 50 of the cylinder 48 about a bracket 82 coupled to the end of the piston 50. The bracket 82 includes a pair of opposed ears 154*a*, 154*b*, each ear including a respective pair of apertures 156*a*, 158*a* and 156*b*, 158*b* configured to receive pins 72 or the like therethrough for coupling the bracket 82 to the coupling portion 76 of the tool 20.

Referring especially to FIG. 7, the driving portion 64 of the cribber tool 20*b* preferably is open at its bottom surface to define a hollow interior. It has been found that forming the driving portion with a hollow interior improves the ability of the cribber tool 20*b* to penetrate the ballast 22 and, thus, dramatically reduces reaction forces imposed on the machine 12 during a cribbing operation. In addition, the hollow interior acts as a scoop that allows the cribber tool 20*b* to displace ballast 22 during both the extension and retraction strokes of the cylinder 48, leading to improved ballast removal.

With continued reference to FIGS. 6 and 7 and additional reference to FIG. 5, the driving portion 64 and connection portion 66 of the cribber tool 20*b* meet at a shoulder 84 that may serve as a stop that abuts against a lower edge of the rail 24 at the end of the cribbing stroke.

Still referring to FIGS. 6 and 7, the cribber tool 20*b* of ballast cribbing assembly 14*b* is configured for use on a right side of the railroad tie 26 as one faces the field side 62 of the railway. Understandably, a corresponding cribber tool 20*a* for use on the ballast cribbing assembly 14*a* on a left side of the railroad tie 26 would have a construction that mirrors that of the cribber tool 20*b* shown in FIGS. 6 and 7. The tool 20*b* has an inner edge 86 configured to slide along the right side of the tie 26 and an opposed outer edge 88. These edges are bridged by a field edge or driving face 90 that is inclined toward the gauge side of the railway along at least the majority of its length. In this manner, the inner edge 86 is configured to "plane" the railroad tie 26 of as much ballast 22 from the area immediately adjacent to the railroad tie 26 as possible. The inclined forward edge of the driving face 90 acts as a plow that is configured to drive the ballast 22 outwardly and to the right of the railroad tie 26 in the configuration shown. The forward edge of the driving face 90 of the opposing cribber tool 20*a* of ballast cribber assembly 14*a*, being a mirror image of the one shown in FIGS. 6 and 7, is inclined in the opposite direction and is configured to drive the ballast 22 outwardly or to the left of the railroad tie 26.

One of the features of the anchor cribbing machine 12 of the present embodiment is to enable the positioning of the cribber tools 20*a*, 20*b* as near as possible to each of the respective sides of the railroad ties 26. This is accomplished by selectively moving the ballast cribbing assemblies 14*a* and 14*b* about the frame 18 longitudinally relative to the rails 24 or toward and away from the ties 26.

Figure 10:
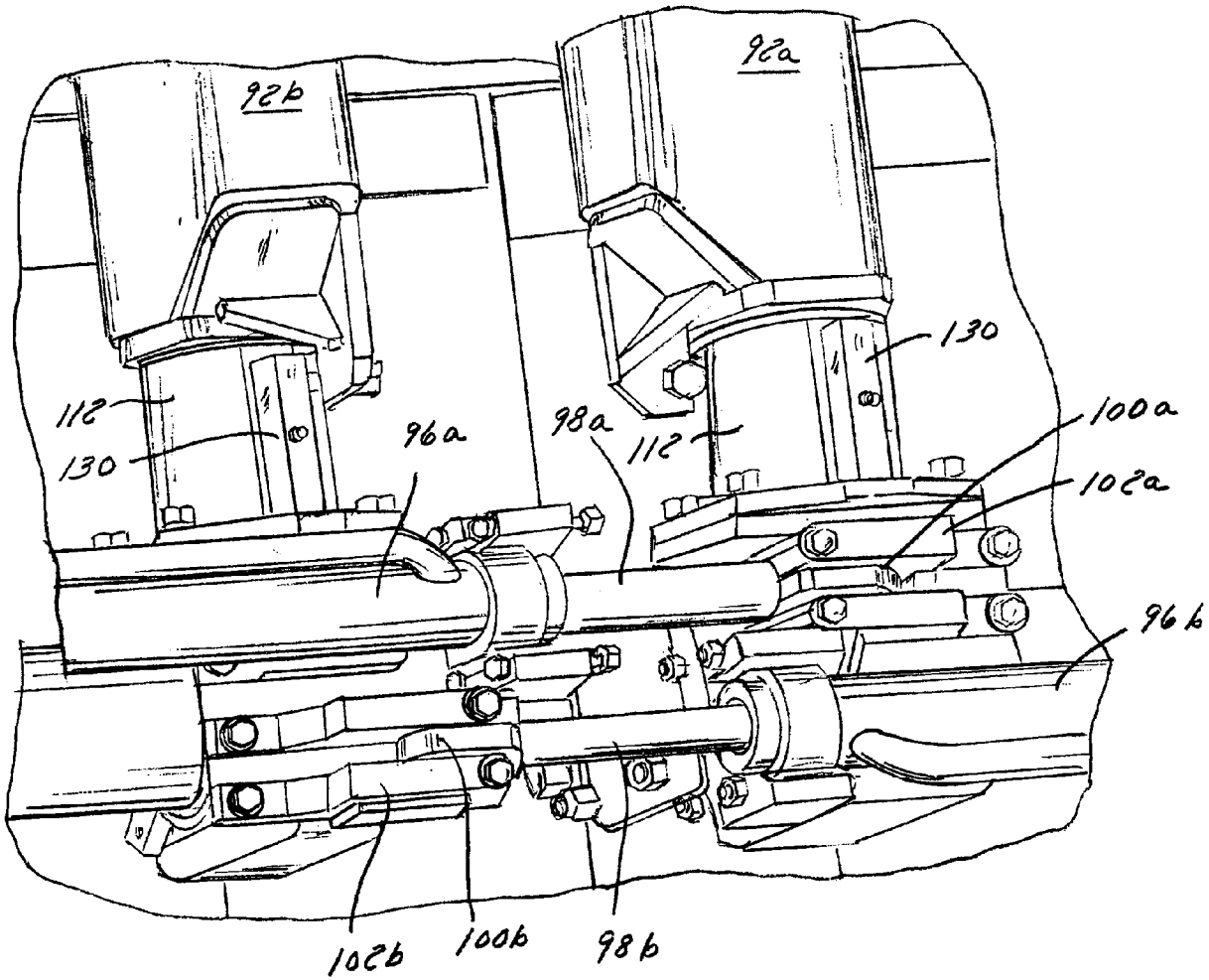
FIG. 10 is a partial isometric view of the anchor cribbing machine of the present invention illustrating additional details of the railroad clamp assembly.
Figure 12:
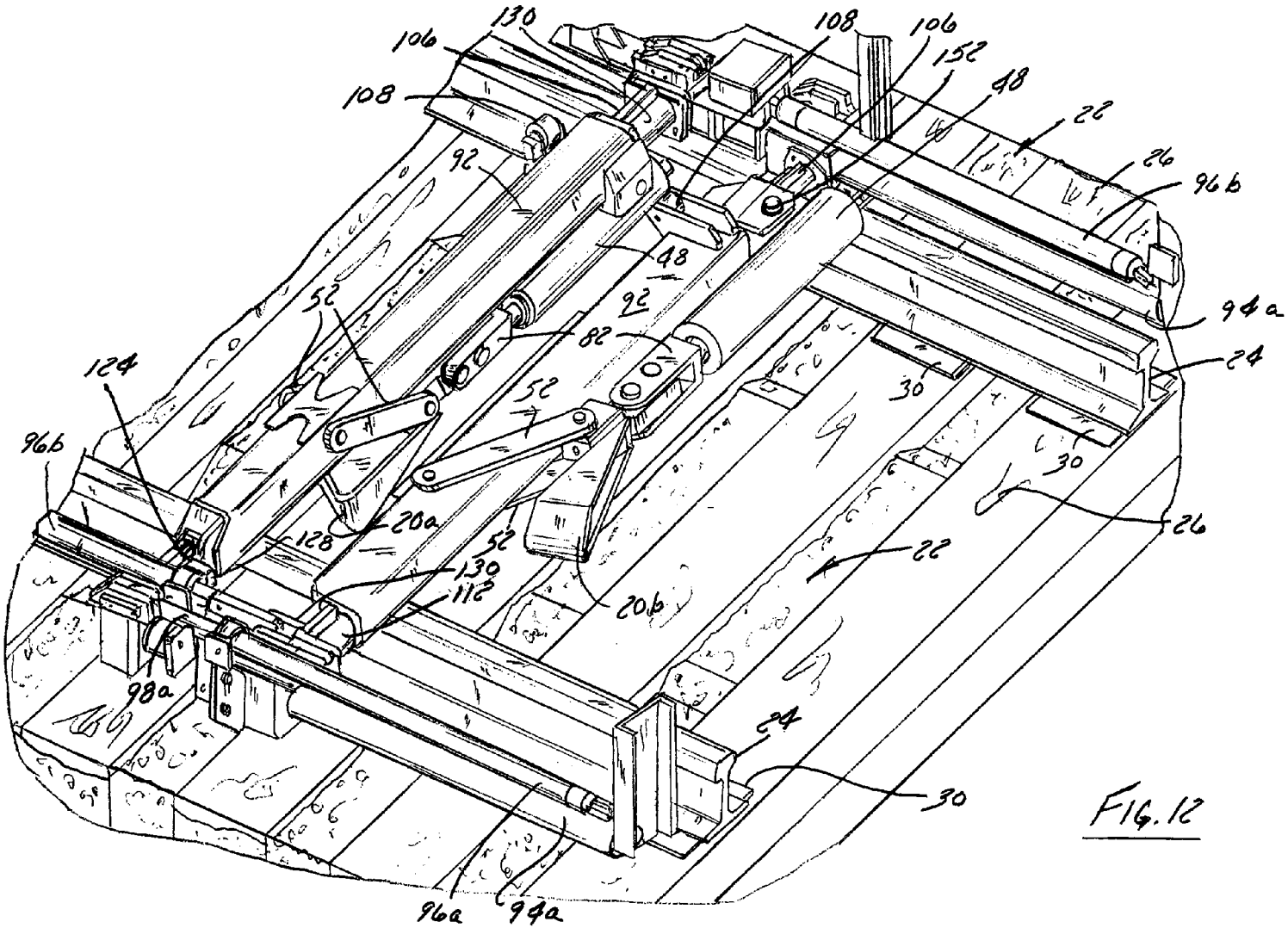
FIG. 12 is an isometric view of the anchor cribbing machine showing one of the ballast cribbing assemblies moved to its stowed position.

Toward this end, and now referring to FIGS. 10 and 12, each of the ballast cribbing assemblies 14*a*, 14*b* includes a respective support beam 92*a*, 92*b* on which the remainder of the cribbing assembly is mounted and which is movable longitudinally of the railroad 28 toward and away from the tie 26. The support beams 92*a*, 92*b* extend in parallel with the tie 26 over the rail 24 being maintained. The cribber tools 20*a*, 20*b* and support beams 92*a*, 92*b* thereof are mounted to longitudinally extending guide rods 94*a*, 94*b* at the gauge and field side ends of the frame 18, respectively. Guide rods 94*a*, 94*b* permit the ballast cribbing assemblies 14*a*, 14*b* to slide toward and away from the tie 26. In particular, each of the beams 92 has cross bores at the opposed ends thereof via which the beam is supported on the guide rods 94*a*, 94*b* for movement with respect thereto. The beams 92*a*, 92*b* are movable along guide rods 94*a*, 94*b* via actuation of associated linear actuators, preferably taking the form of hydraulic cylinders 96*a*, 96*b*. The cylinder 96*a* is associated with and drives the opposing beam 92*b*, and the cylinder 96*b* is associated with and drives its opposing beam 92*a*. By associating each of the cylinders 96 with the respective opposing beam 92, each ballast cribbing assembly 14*a*, 14*b* is provided with adequate clearance to provide additional stroke length within the lateral confines of the machine 12 so that the pistons 98*a*, 98*b* of the cylinders 96*a*, 96*b* can overlap one another. The pistons 98*a*, 98*b* are coupled to the opposing beam 92*b*, 92*a* by way of a pin or similar such coupling known in the art. In this manner, movement of the pistons 98 relative to the cylinders 96 results in longitudinal movement of the opposing beam 92 relative to the rails 24. In this manner, the beams 92 and thereby the ballast cribbing assemblies 14 carried thereby are movable relative to the rails 24 so as to be positionable closely adjacent the tie 26 so that an anchor may be applied to the rail 24 in close proximity to the tie 26.

Still referring to FIG. 12, the pistons 98*a*, 98*b* may have a coupling element 100*a*, 100*b*, respectively, coupled to an end opposite the cylinder 96*a*, 96*b* for securing the pistons 98*a*, 98*b* to the respective beams 92*b*, 92*a*. The beams 92*b*, 92*a* may include a coupling arrangement 102 for securing the beams 92*b*, 92*a* to the respective piston 98*a*, 98*b*. The coupling arrangement 102 may comprise a pair of mounting plates defining a space between which the coupling elements 100 may be received. The mounting plates may include a hole, aperture, recess or the like for receiving a pin configured to couple the mounting plates to the coupling elements 100. In this manner, the pistons 98*a*, 98*b* are coupled to the beams 92*b*, 92*a* to drive movement of the beams 92*b*, 92*a* along the guide rods 94*b*, 94*a* as previously discussed.

As will be discussed in additional detail herein, the movement of the beams 92*a*, 92*b* along the guide rods 94*a*, 94*b* is controlled by operation of the controller assembly 36, which controls the hydraulic flow to each of the cylinders 96*a*, 96*b*. The controller assembly 36 is actuated by operator seated in a seat 37. The hydraulic flow to the cylinders 96*a*, 96*b* may be through a flow divider (not shown) or similar element configured to synchronize the flow to the cylinders 96*a*, 96*b*. As the pistons 98*a*, 98*b* extend from their respective cylinders 96*a*, 96*b*, the opposing beam 92*b*, 92*a* is driven longitudinally relative to the rails 24 along the guide rods 94*a*, 94*b*. Similarly, to reverse movement of the beams 92*a*, 92*b* relative to the rails 24, the controller assembly 36 may be actuated so that the pistons 98*a*, 98*b* are retracted into the respective cylinders 96.

The ballast cribbing assemblies 14 of this embodiment also are configured to be moved vertically and horizontally between a deployed or operative position and a stowed or stored position. When in the deployed position, the cribber tools 20 are positioned so that the cribber tools 20 are positioned for moving ballast 22 as has been described herein. When in the stowed position, the ballast cribbing assemblies 14 are rotated out of the way so that the anchor cribbing machine 12 may be moved longitudinally along the rails 24 or towards and away from each of the railroad ties 26 as previously described. In particular, as will be described in further detail herein, the ballast cribbing assemblies 14 are rotated about a horizontal axis such that they are positioned above the top edge of the railroad rails 24. Preferably, the stowed ballast cribbing assemblies 14 are positioned at a height such that they are able to clear crossings, such as concrete crossings that occur periodically along the length of the railroad rails 24 and are generally elevated above the height of the top edge of the railroad rails 24. This movement could be accomplished through one or more dedicated actuators but, in the present embodiment, is performed by a cam assembly 104 (FIG. 9) that reacts to horizontal movement of the associated ballast cribbing assembly 14 away from the tie 26.

Figure 9:
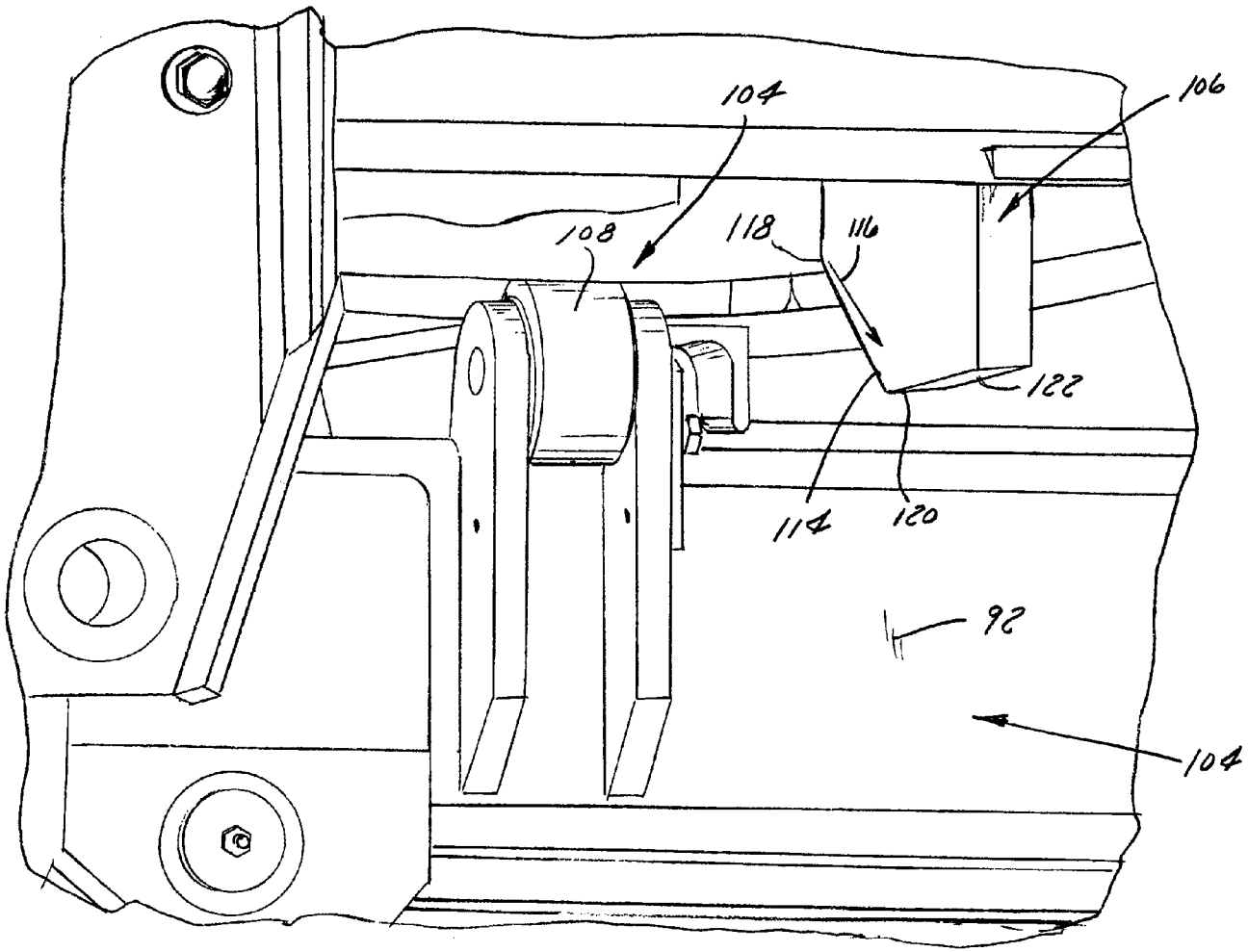
FIG. 9 is an elevation view of a railroad clamp assembly of the anchor cribbing machine of FIG. 1.

Within continuing reference to FIG. 12 and additional reference now to FIG. 9, a preferred cam assembly 104 for driving rotation of the beams 92 about a horizontal axis includes a cam 106 and a cam follower 108 configured to engage the cam 106. The cam 106 of this embodiment is fixed to the frame 18 and the cam follower 108 is fixed to the beam 92. The beam 92 is mounted to bearings 110, 112 at opposing ends thereof about which the beam 92 is configured to rotate relative to the supports for the guide rods 94*a*, 94*b*. As the ballast cribbing assembly 14 moves from the deployed position to the stowed position about guide rods 94*a*, 94*b*, the cam follower 108 travels downwardly along a ramped surface 114 of the cam 106 in a direction indicated by the arrow 116 from an upper edge 118 of the cam 106 toward a bottom edge 120. As the cam follower 108 rides downwardly along the ramped surface 114 of the cam 106, the beam 92 rotates from its operative position toward its stowed position. Upon reaching the bottom of the ramped surface 114 of cam 106, the cam follower 108 rides horizontally along a horizontal surface 122 of the cam 106, maintaining the beam 92 in its rotated position as the beam 92 moves longitudinally toward its stowed position at its furthest point of movement away from the tie 26.

FIG. 12 shows the "right" ballast cribbing assembly 14*b* moved to its stowed position while the "left" ballast cribbing assembly 14*a* is shown in the deployed or operative position. In the stowed position, the link 52 is positioned on top of the respective beams 92, and the cylinder 48 is positioned horizontally adjacent the beam 92. In the operative position, the link 52 is positioned beside the beam 92 while the cylinder 48 is disposed beneath the beam 92.

Still referring to FIG. 12, each of the ballast cribbing assemblies 14 includes a pair of stop assemblies 124 provided on opposing ends of the beam 92 and configured to prevent over-rotation of the beam 92 when moving from the stowed or stored position to the deployed or operative position. Each of the stop assemblies 124 may comprise a bolt 152 or similar element that is mounted on a mounting plate 128 that is secured to the beam 92. The bolt 152 is configured to engage a block element 130 on the associated bearing 110, 112 when the ballast cribbing assembly 14 is in its deployed or operative position. The position of the block element 130 may be adjusted by an operator of the machine 12 during or after initial setup of the machine 12 so as to best position the block element 130 relative to the bolt 152 to ensure that the block element 130 does not engage the bolt 152 before or after the beam 92 is rotated all the way to its deployed or operative position.

Figure 11:
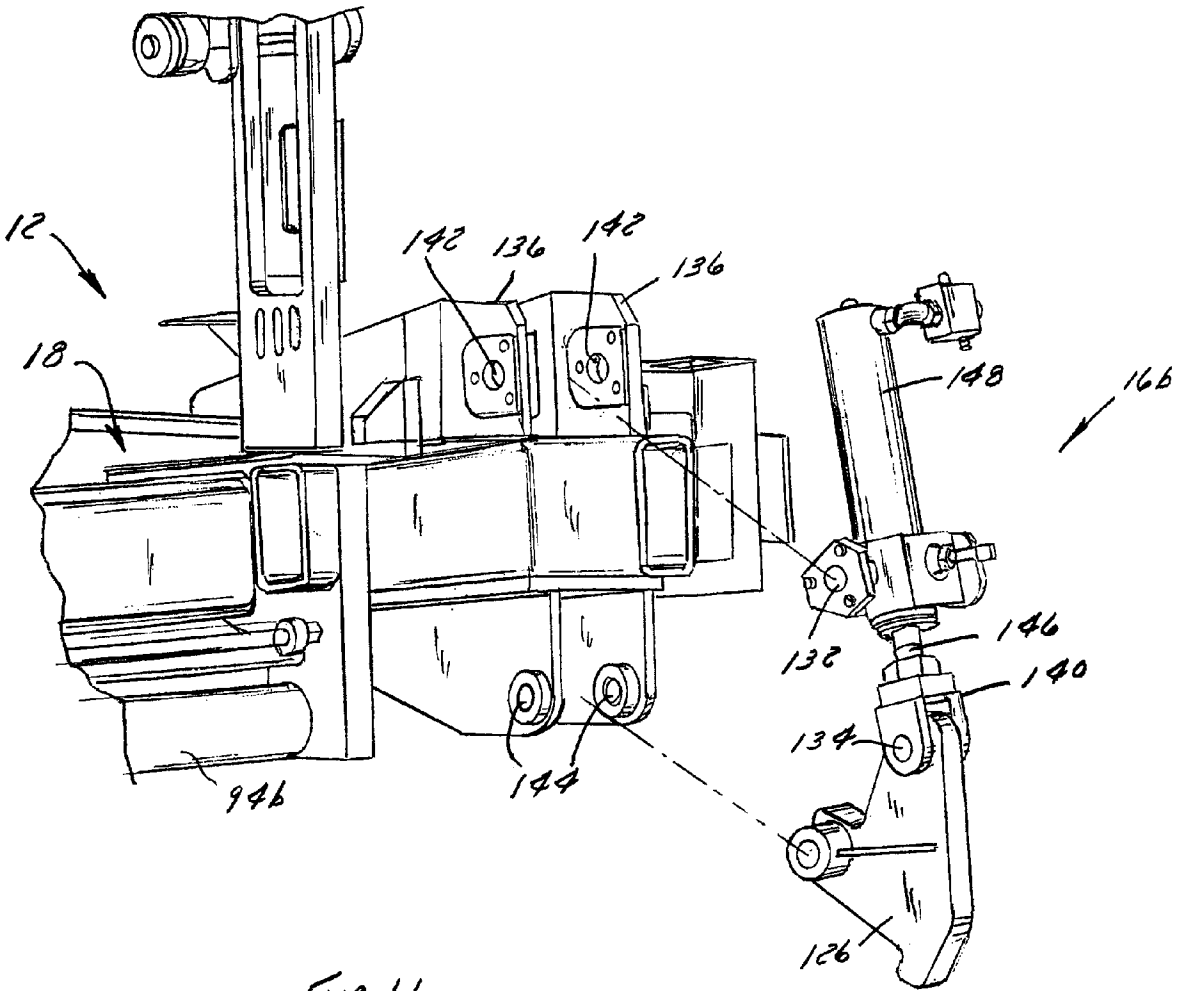
FIG. 11 is a partial isometric view of the anchor cribbing machine of the present invention showing further additional details of the railroad clamp assembly.

Now referring back to FIGS. 4 and 5 as well as FIG. 11, the clamp assemblies 16*a*, 16*b* of the machine 12 are shown. The purpose of the clamp assemblies 16*a*, 16*b* is to prevent the machine 12 from being driven off the rails 24 in the event that one or both of the cribber tools 20 engage the base of the railroad rail 24 when the cribber tool 20 engages the ballast 22 or the rail 24 during operation. Each clamp assembly 16*a*, 16*b* includes a clamp element 126*a*, 126*b*. The clamp elements 126*a*, 126*b* are movably mounted to the frame 18 about a first pivot point 132 and a second pivot point 134 about which the clamp elements 126 may rotate about a horizontal axis defined by a pin or similar element. The clamp assemblies 16*a*, 16*b* are coupled between a pair of opposing side plates 136*a*, 136*b*. Each of the side plates 136*a*, 136*b* includes a pair of vertically spaced holes 142, 144. The pivot point 132 is configured to be positioned between the plates 136*a*, 136*b* and aligned with the holes 142 while the pivot point 134 is aligned with the holes 144. A mounting element 140, which is configured to enable the clamp elements 126*a*, 126*b* to rotate about the pivot point 134 is provided and is coupled to a clamp piston 146 of a clamp cylinder 148. The clamp cylinder 148 may be a hydraulic cylinder or the like.

Figure 4:
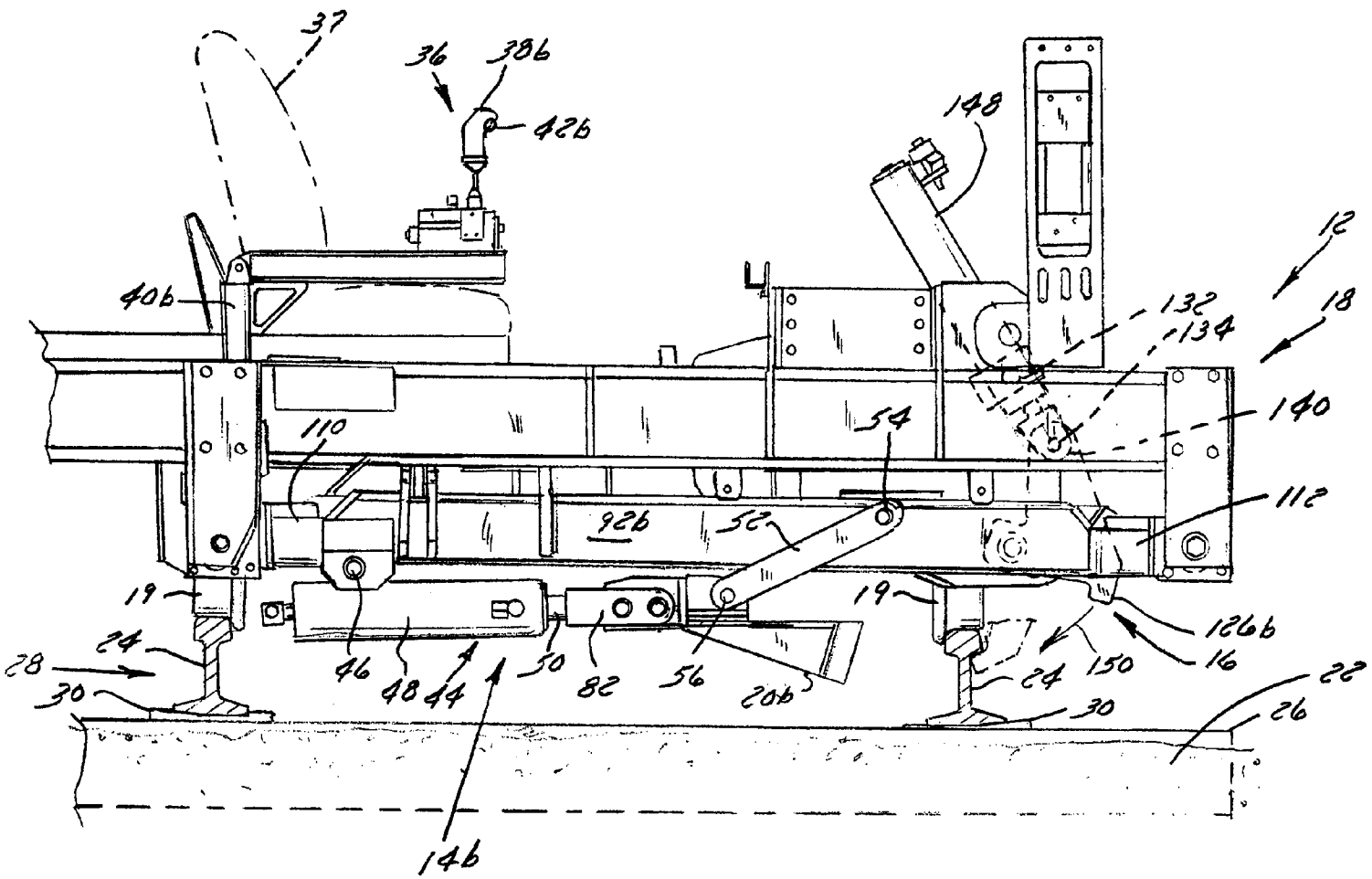
FIG. 4 is a front elevation view of the anchor cribbing machine of FIG. 1, showing a rail clamp assembly in a disengaged configuration and one of the ballast cribbing assemblies in the stowed position.
Figure 5:
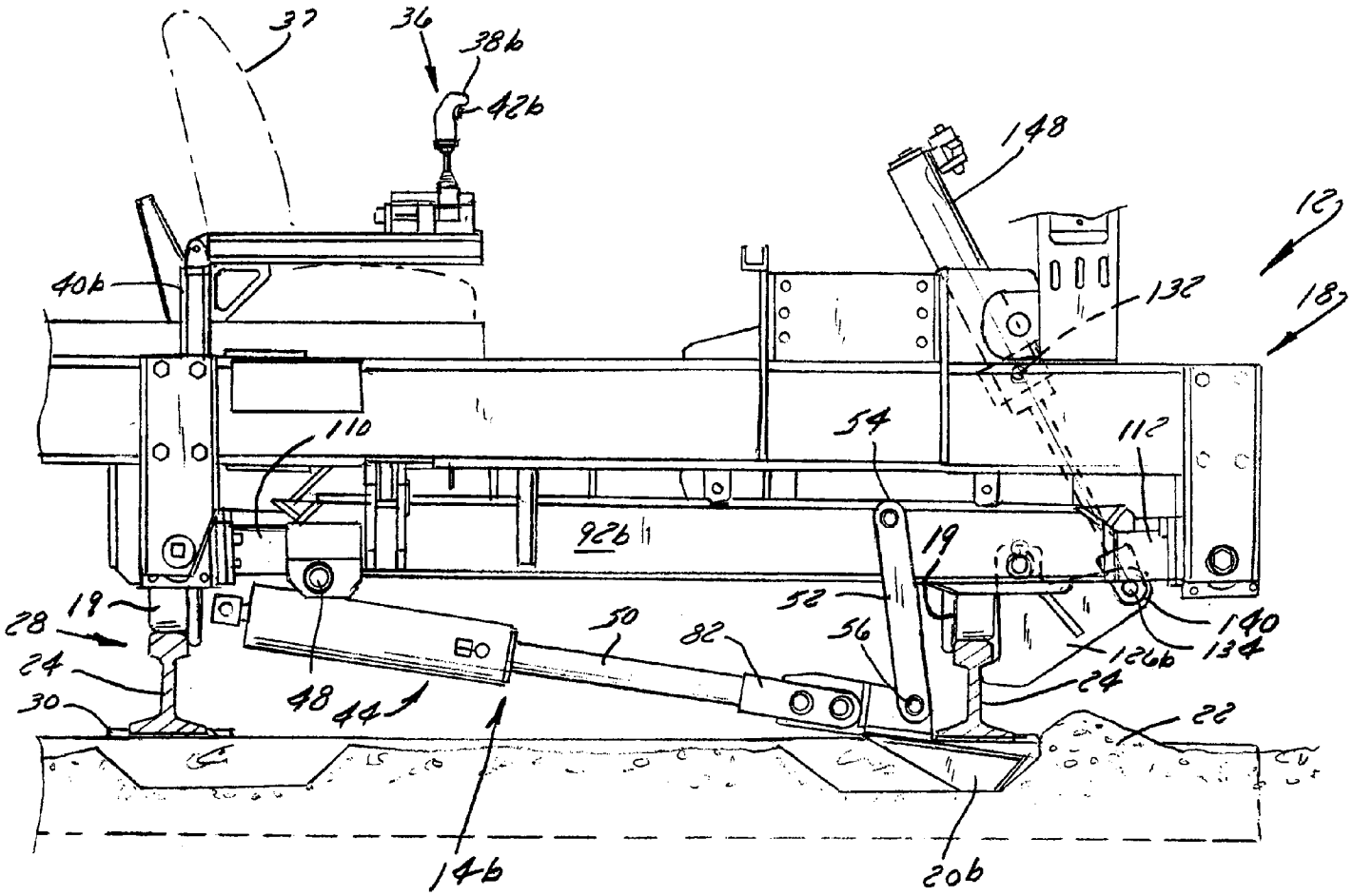
FIG. 5 is a front elevation view of a portion of the anchor cribbing machine of FIG. 1, showing the rail clamp assembly in an engaged configuration and one of the ballast cribbing assemblies in the operative position.

The clamp element 126 in FIG. 4 is shown in its disengaged position. To move the clamp elements 126 from the disengaged to engaged position, the clamp elements 126 are rotatable about the pivot points 132, 134. Actuation of the controller assembly 36 causes the clamp elements 126 to rotate between the disengaged position and the engaged position. In particular, movement of the controller 38 on either side of the machine 12 in a positive Y-direction causes the associated clamp piston 146 to extend from the clamp cylinder 148, which causes the clamp elements 126 to swing in a direction indicated by an arrow 150 (as shown in FIG. 4) to a level beneath the head or upper edge of the rail 24 and into engagement with the rail 24 (as shown in FIG. 5). To move one of the clamp assemblies 16 from the engaged to disengaged positions, the associated assembly controller 38 is moved in a negative Y-direction so that the clamp piston 146 retracts relative to the clamp cylinder 148 such that the clamp elements 126 swing away from the rail 24 and toward the disengaged position. Of course, the clamp assemblies 16 may be alternatively constructed or arranged relative to the controller assembly 36 such that positive Y-direction of the controller 38 causes the clamp elements 126 to move toward the disengaged position, and negative Y-direction movement of the controller 38 causes the clamp elements 126 to move toward the engaged position. In any event, the clamp assemblies 16 move into engagement with the rail 24 before the cribbing stroke is initiated and move out of engagement with the rail 24 only after the cribbing stroke is complete, preventing the machine 12 from being accidentally driven off of the frame 18 as previously noted.

Operation of one of the ballast cribbing assemblies 14*b* will now be described with reference to FIGS. 4 and 5, it being understood that the ballast cribbing assembly 14*a* operates in the same manner. The vehicle 10 is first positioned with the ballast cribbing assembly 14*b* of the ballast cribbing machine 12 located between two adjacent ties 26. The operator of the machine 12 moves the controller 38*b* in the X direction or toward the associated side of the tie 26 to cause the cylinder 96*a* to move the associated ballast cribbing assembly 14*b* so as to position the associated cribbing tool 20*b* as close as possible to the associated side of the tie 26. During this operation, the cam assembly 104 drives the beam 92*b* to rotate to rotate the ballast cribbing assembly 14*b* from its raised, stowed position to the lowered, operative position. The operator then moves the controller 38*b* in the forward Y direction to initiate movement of the associated rail clamp assembly 16*b* from the disengaged position located above and outboard of the field side of the rail 24 to the engaged position in contact with the field side of the rail 24.

Once the rail clamp assembly 16*a* or 16*b* reaches the engaged position, continued actuation in the forward Y-direction initiates extension of the ballast cribber assembly 14*b*. In particular, the continued actuation in the forward Y-direction causes the piston 50 to extend from the cylinder 48 to move the cribber tool 20*b* through an arc from an initial position in which the cribber tool 20*b* is located inboard of the gauge side of the rail 24 and above the level of the ballast 22 into engagement with the ballast 22 for movement thereof. In the initial positions shown in FIG. 4, the ballast cribbing assembly 14*a* or 14*b* is positioned in the deployed position but not engaged with the ballast 22. Continued movement of the ballast cribbing assembly 14*b* in the forward Y-direction of the controller 38*b* moves the ballast cribbing assembly 14*b* from this initial position through and into engagement with the ballast as shown in FIG. 5 in which cribber tool 20*b* moves beneath the field side of rail 24 and engages the ballast 22 and moves the ballast away from the railroad tie 26 in the process. The trigger 42*b* can then be actuated to cause the associated anchor applicator 200 (FIG. 1) to apply an anchor. Movement of the controller 38*b* in the reverse Y-direction first causes the ballast cribbing assembly 14*b* to retract by retracting the piston 50 into the cylinder 48 and then subsequently retracts the associated rail clamp assembly 16*b*.

The operator then may move the ballast removing assemblies 14 from the deployed position to the stowed position for movement of the assemblies 14 along the longitudinal axis defined by the rails 24. This operation is carried out by movement of the controllers 38 in the X direction away from the tie 26 to cause the ballast cribbing assemblies 14 to rotate toward the stowed position by operation of the cam 104 as the beams 92 move away from the tie 26. The vehicle 10 can then be positioned over the next tie 26 to be worked.

Although the best mode contemplated by the inventors of carrying out the present invention is disclosed above, practice of the present invention is not limited thereto. It will be manifest that various additions, modifications and rearrangements of the aspects and features of the present invention may be made in addition to those described above without deviating from the spirit and scope of the underlying inventive concept.

For example, some if not all aspects of the anchor cribber as described herein may be used on a stand-alone machine rather than with an anchor applicator or may be used on a different type of machine than a rail applicator. The scope of some of these changes is discussed above. The scope of other changes to the described embodiments that fall within the present invention but that are not specifically discussed above will become apparent from the appended claims and other attachments.

We claim:

1. A machine comprising:

a frame that is movable along a railway comprising at least one rail supported on railroad ties;

a ballast cribbing assembly movably coupled to the frame and configured for selectively moving ballast away from the railroad tie beneath the rail, the ballast cribbing assembly comprising a cribber tool having an outer driving face that is movable from a first position located on a gauge side of the rail and above the ballast to second position located beneath a field side of the rail, thereby to force ballast from beneath the rail to a position outboard of the field side of the rail.

2. The machine of claim 1, wherein the cribber tool reciprocates through an arc that is transverse to the railway during operation thereof.

3. The machine of claim 2, wherein the ballast cribbing assembly further comprises a piston and cylinder device that is coupled to the cribber tool and that is selectively extendible and retractable to move the cribber tool through the arc; and a link having a first end and a second end opposite the first end, wherein the first end of the link is pivotally coupled to the frame and the second end of the link is pivotally coupled to the cribber tool.

4. The machine of claim 3, wherein the piston and cylinder device is pivotally mounted on the frame at a position inboard of a mounting point for the first end of the link, and wherein the link extends vertically through a portion of its stroke.

5. The machine of claim 4, wherein the piston and cylinder device and the first end of the link are pivotally mounted on a common horizontally-extending beam.

6. The machine of claim 2, wherein the cribber tool has a bottom end that is at least partially open to expose a hollow interior of the cribber tool, the hollow interior defining a scoop that allows the cribber tool to displace ballast during both extension and retraction strokes of the piston and cylinder device.

7. The machine of claim 1, further comprising a horizontally extending beam mounted to the frame and bearing the at least one ballast cribbing assembly, and wherein the beam is rotatable about a longitudinal axis thereof to move the ballast cribbing assembly between an operative position and a stowed position.

8. The machine of claim 7, wherein the beam is movable horizontally toward and away from the tie.

9. The machine of claim 1, wherein the ballast cribbing assembly is a first ballast cribbing assembly that is configured for placement adjacent a first side of a railroad tie, and further comprising a second ballast cribbing assembly that is mounted on the frame and that is configured for placement adjacent a second side of the railroad tie opposite the first side, the second ballast cribbing assembly including a cribber tool that moves through at least essentially the same stroke as the cribber tool of the first ballast cribbing assembly.

10. A machine comprising:

a frame that is movable along a railway comprising at least one rail supported on railroad ties;

a ballast cribbing assembly movably coupled to the frame and configured for selectively moving ballast away from the railroad tie beneath the rail, the ballast cribbing assembly comprising a cribber tool having an outer driving face that is movable from a first position located on a gauge side of the rail and above the ballast to second position located beneath a field side of the rail, thereby to force ballast from beneath the rail to a position outboard of the field side of the rail; and an anchor applying assembly mounted on the frame and configured to couple at least one anchor to a railroad rail.

11. A method comprising the steps of:

engaging a rail with a clamp assembly that is mounted on a frame of a mobile machine that is movable a long a railway containing the rail; and driving a ballast cribbing assembly relative to a frame beneath a rail to move ballast away from a railroad tie on which the rail is supported, wherein the driving step comprises extending a piston and cylinder device of the ballast cribbing assembly to drive a cribbing tool of the ballast cribbing assembly through an arc extending from a first position located on a gauge side of the rail and above the ballast to second position located beneath a field side of the rail, thereby to force ballast from beneath the rail to a position outboard of the field side of the rail.

12. The method of claim 11, further comprising the step of moving the ballast cribbing assembly vertically between an operative in which the ballast cribbing assembly is positioned relative close to the level of the rail and a stowed position in which the ballast cribbing assembly is located relative far from the level of the rail.

13. The method of claim 12, wherein the moving step comprises rotating a horizontal support beam on which the ballast cribbing is mounted about a horizontal axis.

14. A machine comprising:

a frame that is movable along a railway comprising at least one rail supported on railroad ties;

a ballast cribbing assembly that is movably coupled to the frame and that is configured for selectively moving ballast away from the railroad tie beneath the rail, the ballast cribbing assembly comprising a cribber tool moving bidirectionally beneath the rail through extension and retraction strokes thereof, the cribber tool having an enclosed end surface forming a driving face, an enclosed upper surface, and a bottom end surface that is at least partially open to expose a hollow interior of the cribber tool, the hollow interior defining a scoop that allows the cribber tool to displace ballast during both the extension and retraction strokes of the cribber tool.

15. The machine of claim 14, wherein the driving face of the cribber tool is an outer driving face that is movable from a first position located on a gauge side of the rail and above the ballast to second position located beneath a field side of the rail, thereby to force ballast from beneath the rail to a position outboard of the field side of the rail.

16. The machine of claim 14, further comprising a piston and cylinder device that is coupled to the cribber tool and that is selectively extendible and retractable to move the cribber tool relative to the railway through an arc that is transverse to the railway, the piston and cylinder device being pivotally mounted on the frame at a first location; and a link having a first end and a second end opposite the first end, wherein the first end of the link is pivotally coupled to the frame and the second end of the link is pivotally coupled to the piston and cylinder device at a second location between the cribber tool and the first location, wherein the link extends vertically through a portion of its stroke.

17. The machine of claim 14, wherein the ballast cribbing assembly is a first ballast cribbing assembly that is configured for placement adjacent a first side of a railroad tie, and further comprising a second ballast cribbing assembly that is mounted on the frame and that is configured for placement adjacent a second side of the railroad tie opposite the first side, the second ballast cribbing assembly including a cribber tool that moves through at least essentially the same stroke as the cribber tool of the first ballast cribbing assembly.

18. A machine comprising:

a frame that is movable along a railway comprising at least one rail supported on railroad ties:

first and second ballast cribbing assemblies spaced longitudinally of one another in the direction of the railway so as to be positionable on opposite sides of a railroad tie, each ballast cribbing assembly including a cribber tool that is movably coupled to the frame so as to move transversely relative to the rail to move ballast away from beneath the rail, wherein each cribber tool is movable bidirectionally beneath the rail through extension and retraction strokes thereof and has an enclosed end surface forming a driving face, an enclosed upper surface, and a bottom end surface that is at least partially open to expose a hollow interior of the cribber tool, the hollow interior defining a scoop that allows the cribber tool to displace ballast during both the extension and retraction strokes of the cribber tool.

19. A machine comprising:

a frame that is movable along a railway comprising at least one rail supported on railroad ties;

first and second ballast cribbing assemblies spaced longitudinally of one another in the direction of the railway so as to be positionable on opposite sides of a railroad tie, each ballast cribbing assembly including a cribber tool that is movably coupled to the frame so as to move transversely relative to the rail to move, ballast away from beneath the rail, wherein each cribber tool has an outer driving face that is movable from a first position located on a gauge side of the rail and above the ballast to second position located beneath a field side of the rail, thereby to force ballast from beneath the rail to a position outboard of the field side of the rail.

20. A machine comprising:

a frame that is movable along a railway comprising at least one rail supported on railroad ties;

a ballast cribbing assembly movably coupled to the frame and configured for selectively moving ballast away from the railroad tie beneath the rail, the ballast cribbing assembly comprising a cribber tool having a driving face;

a piston and cylinder device that is coupled to the cribber tool at a first end thereof and that is selectively extendible and retractable to move the cribber tool relative to the railway through an arc that is transverse to the railway, the piston and cylinder device being pivotally mounted on the frame at a first location, and a link having a first end and a second end opposite the first end, wherein the first end of the link is pivotally coupled to the frame and the second end of the link is pivotally coupled to the piston and cylinder device at a second location between the cribber tool and the first location, wherein the link extends vertically through a portion of its stroke.

21. The machine of claim 20, wherein the driving face of the cribber tool is an outer driving face that is movable from a first position located on a gauge side of the rail and above the ballast to second position located beneath a field side of the rail, thereby to force ballast from beneath the rail to a position outboard of the field side of the rail.

22. The machine of claim 20, wherein the cribber tool is movable bidirectionally beneath the rail through extension and retraction strokes thereof and has an enclosed end surface forming the driving face, an enclosed upper surface, and a bottom end surface that is at least partially open to expose a hollow interior of the cribber tool, the hollow interior defining a scoop that allows the cribber tool to displace ballast during both the extension and retraction strokes of the cribber tool.

* * * * *